US008579211B2

(12) United States Patent
Bathina et al.

(10) Patent No.: US 8,579,211 B2
(45) Date of Patent: Nov. 12, 2013

(54) SYSTEM AND METHOD FOR ENHANCING FLOW IN A NOZZLE

(75) Inventors: Mahesh Bathina, Bangalore (IN); Willy Steve Ziminsky, Greenville, SC (US)

(73) Assignee: General Electric Company, Schenectady, NY (US)

( * ) Notice: Subject to any disclaimer, the term of this patent is extended or adjusted under 35 U.S.C. 154(b) by 353 days.

(21) Appl. No.: 12/985,572

(22) Filed: Jan. 6, 2011

(65) Prior Publication Data

US 2012/0175430 A1 Jul. 12, 2012

(51) Int. Cl.
*B05B 7/10* (2006.01)
*B05B 1/34* (2006.01)
*A62C 5/00* (2006.01)

(52) U.S. Cl.
USPC ..... 239/405; 239/11; 239/402; 239/403; 239/463; 239/466

(58) Field of Classification Search
USPC ..... 239/11, 398, 399, 402, 403, 405, 463, 239/466
See application file for complete search history.

(56) References Cited

U.S. PATENT DOCUMENTS

| | | | | | |
|---|---|---|---|---|---|
| 1,353,112 | A * | 9/1920 | Clarke | 239/405 |
| 1,593,186 | A * | 7/1926 | McKean et al. | 239/402 |
| 3,765,609 | A * | 10/1973 | Robic | 239/405 |
| 6,141,967 | A * | 11/2000 | Angel et al. | 60/737 |
| 6,438,961 | B2 | 8/2002 | Tuthill et al. | |
| 6,993,916 | B2 * | 2/2006 | Johnson et al. | 60/776 |
| 2009/0183511 | A1 | 7/2009 | Dinu | |

* cited by examiner

*Primary Examiner* — Justin Jonaitis
(74) *Attorney, Agent, or Firm* — Dority & Manning, PA

(57) ABSTRACT

A nozzle includes a center body that defines an axial centerline and a shroud circumferentially surrounding at least a portion of the center body to define an annular passage between the center body and the shroud. A plurality of vanes between the center body and the shroud comprise a radially outward portion separated from the shroud. A method for enhancing flow through a nozzle includes flowing a fuel through a center body and flowing a fluid stream across a vane located between the center body and a shroud surrounding at least a portion of the center body. The method further includes flowing the fluid stream between a radially outward portion of the vane and the shroud, wherein the radially outward portion of the vane is separated from the shroud.

17 Claims, 3 Drawing Sheets

SYSTEM AND METHOD FOR ENHANCING FLOW IN A NOZZLE

FIELD OF THE INVENTION

The present invention generally involves a system and method for enhancing flow in a nozzle. In particular, embodiments of the present invention may provide a system and method for reducing or preventing flame holding from occurring at particular locations in the nozzle.

BACKGROUND OF THE INVENTION

Combustors are known in the art for igniting fuel with air to produce combustion gases having a high temperature and pressure. For example, gas turbine systems, aircraft engines, and numerous other combustion-based systems include one or more combustors that mix a working fluid, such as air, with fuel and ignite the mixture to produce high temperature and pressure combustion gases. Each combustor generally includes one or more nozzles that mixes the working fluid with the fuel prior to combustion.

It is widely known that the thermodynamic efficiency of a combustion-based system generally increases as the operating temperature, namely the combustion gas temperature, increases. However, if the fuel and air are not evenly mixed prior to combustion, localized hot spots may form in the combustor. The localized hot spots increase the chance for the flame in the combustor to flash back into the nozzles and/or become attached inside the nozzles which may damage the nozzles. Although flame flash back and flame holding may occur with any fuel, they occur more readily with high reactive fuels, such as hydrogen, that have a higher burning rate and wider flammability range.

A variety of techniques exist to allow higher operating temperatures while minimizing flash back and flame holding. Many of these techniques seek to reduce localized hot spots and/or reduce low flow zones to reduce or prevent the occurrence of flash back or flame holding. For example, continuous improvements in nozzle designs result in more uniform mixing of the fuel and air prior to combustion to reduce or prevent localized hot spots from forming in the combustor. Alternately, or in addition, nozzles have been designed to ensure a minimum flow rate of fuel and/or air through the nozzle to prevent the combustor flame from flashing back into the nozzle. Continued improvements in nozzle designs and methods that reduce low flow areas and flow separation regions would be useful.

BRIEF DESCRIPTION OF THE INVENTION

Aspects and advantages of the invention are set forth below in the following description, or may be obvious from the description, or may be learned through practice of the invention.

One embodiment of the present invention is a nozzle that includes a center body that defines an axial centerline and a shroud circumferentially surrounding at least a portion of the center body to define an annular passage between the center body and the shroud. The nozzle further includes a plurality of vanes between the center body and the shroud, wherein each of the plurality of vanes comprises a radially outward portion separated from the shroud.

Another embodiment of the present invention is a nozzle that includes a center body that defines an axial centerline and a shroud circumferentially surrounding at least a portion of the center body to define an annular passage between the center body and the shroud. The nozzle further includes a plurality of vanes between the center body and the shroud, wherein each of the plurality of vanes comprises a pressure side and a vacuum side. A plurality of ports in the shroud is proximate to the vacuum side of each of the plurality of vanes.

The present invention also includes a method for enhancing flow through a nozzle. The method includes flowing a fuel through a center body and flowing a fluid stream across a vane located between the center body and a shroud surrounding at least a portion of the center body. The method further includes flowing the fluid stream between a radially outward portion of the vane and the shroud, wherein the radially outward portion of the vane is separated from the shroud.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
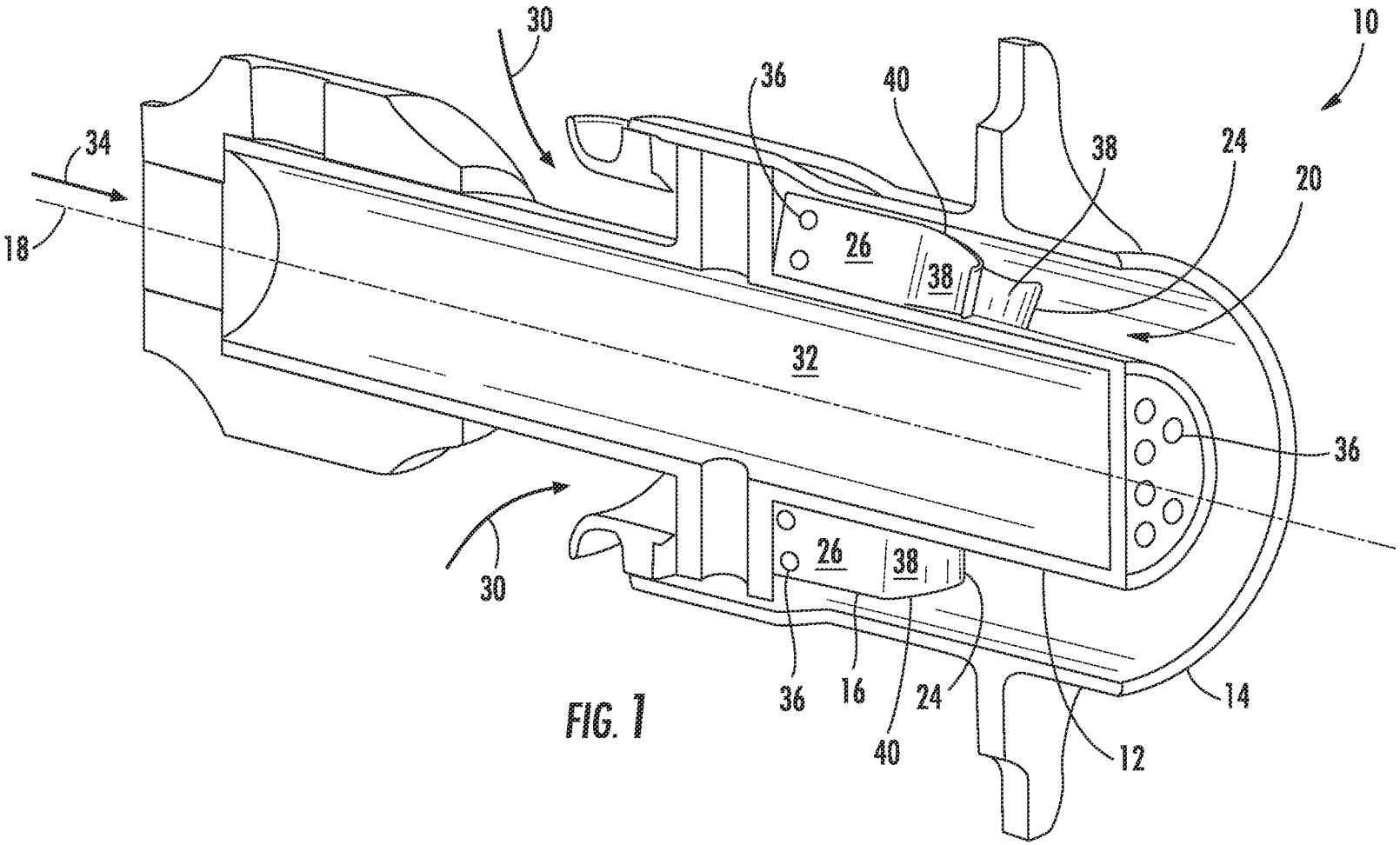
FIG. 1 is a simplified perspective view of a nozzle according to one embodiment of the present invention.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

FIG. 1 shows a perspective view of a nozzle 10 according to one embodiment of the present invention. As shown in FIG. 1, the nozzle 10 generally includes a center body 12, a shroud 14, and a plurality of vanes 16. The center body 12 generally extends along and defines an axial centerline 18 of the nozzle 10. The shroud 14 circumferentially surrounds at least a portion of the center body 12 to define an annular passage 20 between the center body 12 and the shroud 14. The vanes 16 generally comprise a leading edge 22 (not visible in FIG. 1) and a trailing edge 24 and extend radially between the center body 12 and the shroud 14 in the annular passage 20. In particular embodiments, the vanes 16 may be curved or angled with respect to the axial centerline 18, resulting in a pressure side 26 and a vacuum side 28 for each vane 16. A working fluid 30, such as air, may flow into the annular passage 20 and over the vanes 16. A plenum 32 in the center body 12 may supply fuel 34 to the center body 12 and/or the vanes 16. Fuel ports 36 in the center body 12 and/or vanes 16 may provide fluid communication for the fuel 34 to flow from the plenum 32 into the annular passage 20. In this manner, the fuel 34 may flow through the fuel ports 36 in the center body 12 and/or the vanes 16, and the vanes 16 may direct and/or swirl the fuel 34 and/or the working fluid 30 to enhance the mixing of the fuel 34 and/or working fluid 30 in the annular passage 20 prior to exiting the nozzle 10.

Operational experience, testing, and computational fluid dynamic calculations indicate that the vanes 16 may produce an environment conducive to flame holding. In particular, the vacuum side 28 and/or the trailing edge 24 of the vanes 16 may produce low flow areas or flow separation areas conducive to flame holding. Various embodiments of the present invention provide increased flow and/or contouring of the nozzle surfaces to reduce the occurrence of flame holding and, if flame holding occurs, to reduce and/or prevent any damage to the nozzle surfaces. In this manner, various embodiments of the present invention may reduce low velocity areas associated with the vanes 16 to reduce the potential for and/or consequences of flame holding in the nozzle 10.

As shown in FIG. 1, each vane 16 may comprise a curved surface 38 that imparts tangential velocity or swirl to the fuel 34 and/or working fluid 30 flowing over the vanes 16. As shown in FIG. 1, the vanes 16 may further comprise a radially outward portion 40 that is separated from the shroud 14. The radially outward portion 40 may be curved or contoured away from the shroud 14 so that the trailing edge 24 of the vane 16 is tapered radially inward from the shroud 14. In this configuration, the fuel 34 and/or working fluid 30 may flow between the radially outward portion 40 and the shroud 14 to increase fluid flow on the flow separating region of the vacuum side 28 and/or near the trailing edge 24 of the vanes 16.

Figure 2:
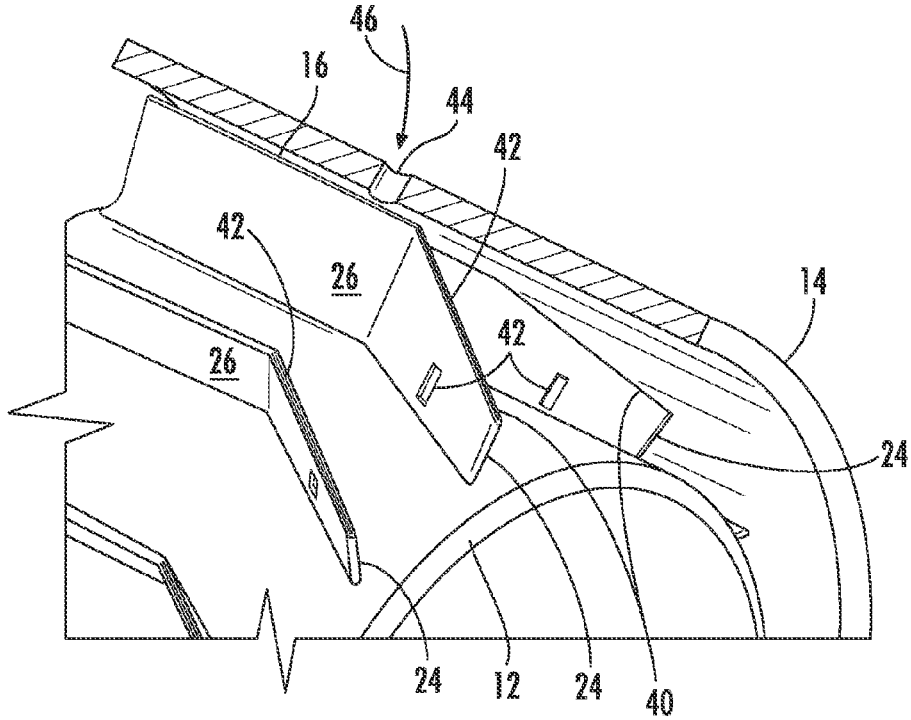
FIG. 2 is an enlarged perspective view of the vanes according to a second embodiment of the present invention.
Figure 3:
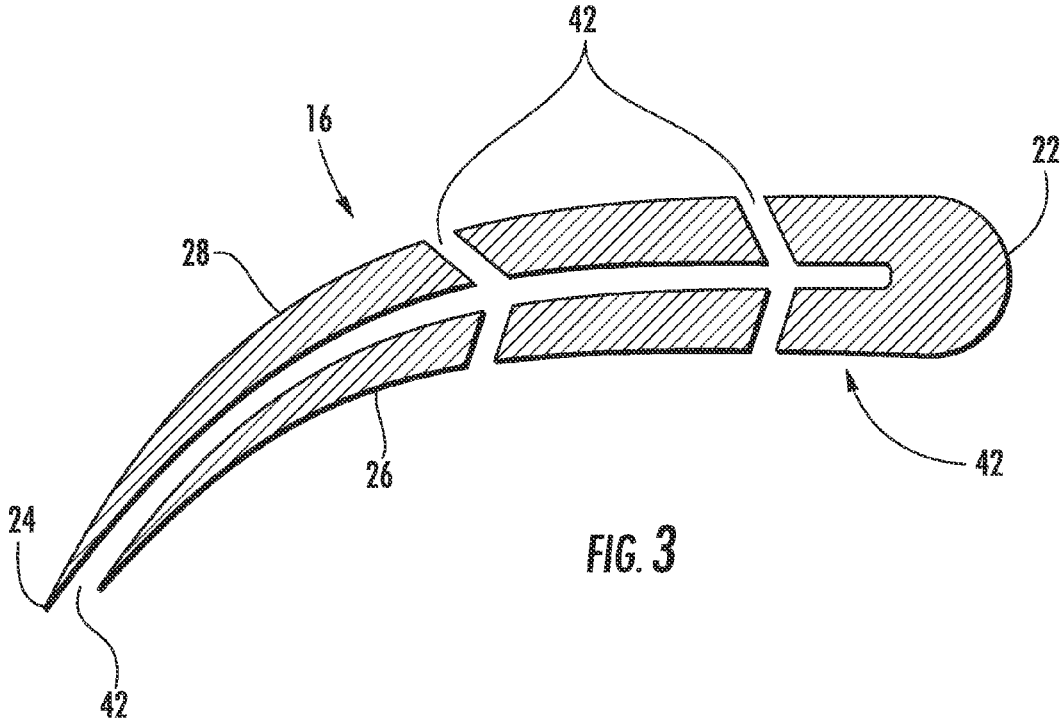
FIG. 3 is a side cross-section view of a vane according to an alternate embodiment of the present invention.

FIG. 2 provides an enlarged perspective view of the center body 12, shroud 14, and vanes 16 according to an alternate embodiment of the present invention. In this particular embodiment, the vanes 16 generally comprise a straight surface angled with respect to the axial centerline 18 to impart tangential velocity or swirl to the fuel 34 and/or working fluid 30 flowing over the vanes 16. The vanes 16 again include the radially outward portion 40 that is separated from the shroud 14, as previously described with respect to the embodiment shown in FIG. 1. In addition, the vanes 16 include an opening 42, aperture, port, passage, or hole in the radially outward portion 40 and/or one or both of the pressure or vacuum sides 26, 28 of the vane 16. As used herein, the terms "opening", "aperture", "port", "passage", and "hole" are intended to be substantially identical in meaning and may be used as synonyms for one another. FIG. 3 provides a side cross-sectional view of a curved vane 16 showing the openings 42 in the radially outward portion 40 and the pressure and vacuum sides 26, 28. As shown in FIG. 2, a passage 44 between the shroud 14 and the vanes 16 or the center body 12 and the vanes 16 may provide fluid communication for a fluid stream 46 to flow through the vanes 16 and out of the opening 42 in the radially outward portion 40. For example, the fluid stream 46 may comprise the working fluid 30, steam, an inert gas, a diluent, or another suitable fluid known to one of ordinary skill in the art. In this manner, the fluid stream 46 provides additional flow over the trailing edge 24 and/or pressure or vacuum sides 26, 28 of the vanes 16. In addition, computational fluid dynamic calculations indicate that the additional flow of the fluid stream 46 through the openings 42 in the radially outward portion 40 and/or the pressure and vacuum sides 26, 28 may reduce areas of low circulation on either side of the trailing edge 24 of the vanes 16.

Figure 4:
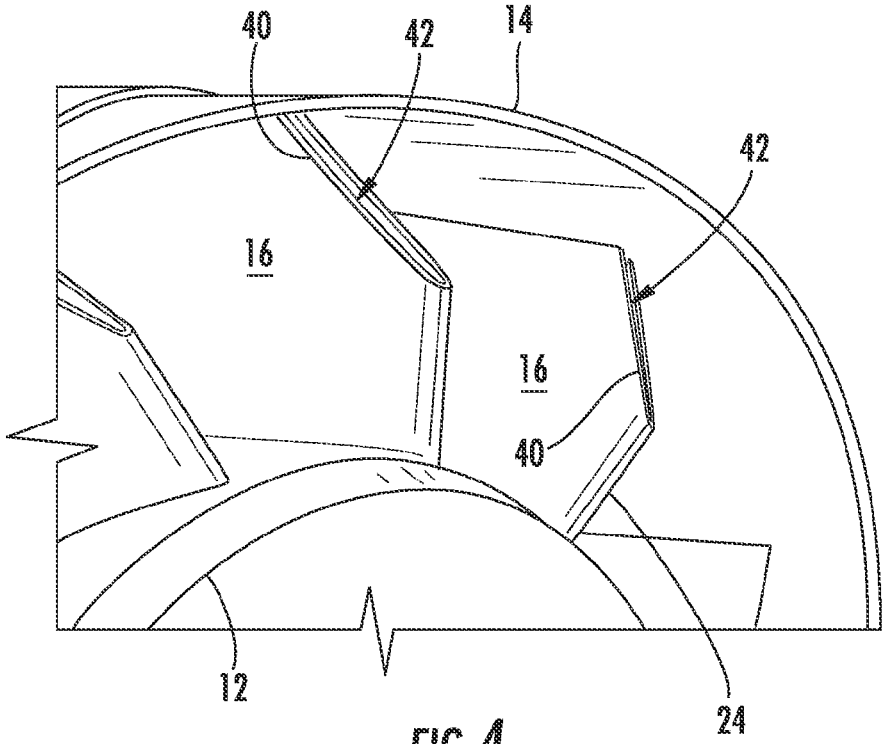
FIG. 4 is an enlarged perspective view of the vanes according to a third embodiment of the present invention.

FIG. 4 provides an enlarged perspective view of the center body 12, shroud 14, and vanes 16 according to another embodiment of the present invention. In this particular embodiment, the vanes 16 generally comprise a straight surface aligned with the axial centerline 18 to direct the fuel 34 and/or working fluid 30 flowing over the vanes 16. The vanes 16 again include the radially outward portion 40 that is separated from the shroud 14, as previously described with respect to the embodiments shown in FIGS. 1 and 2. In addition, the vanes 16 again include the opening 42 in the radially outward portion 40 to allow the fluid stream 46 to flow through the vanes 16 and provide additional flow to the radially outward portion 40 and/or the trailing edge 24 of the vanes 16.

Figure 5:
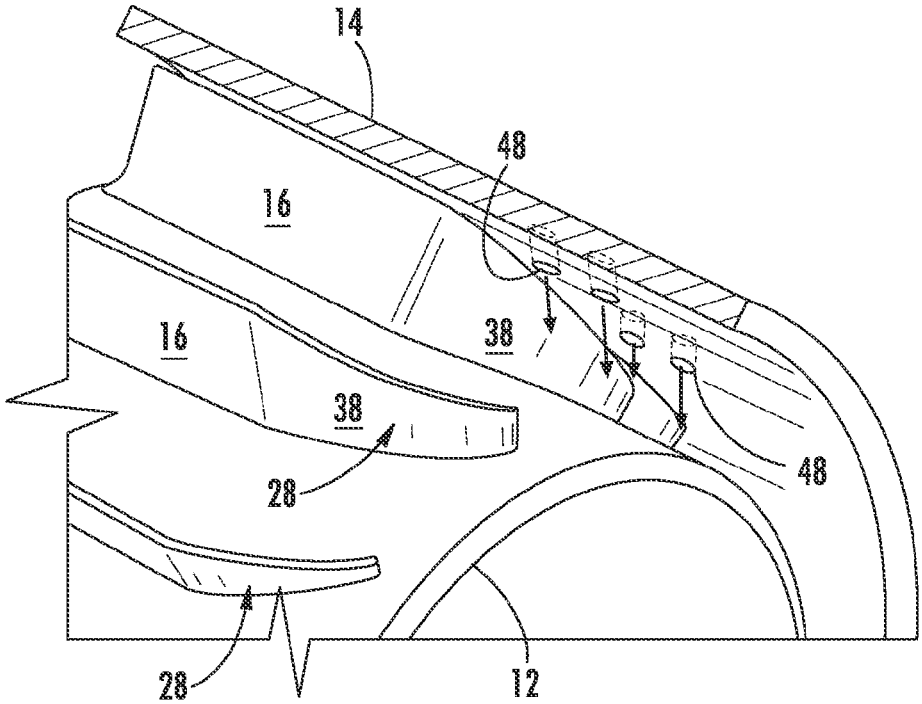
FIG. 5 is an enlarged perspective view of a nozzle according to an alternate embodiment of the present invention.

FIG. 5 provides an enlarged perspective view of the center body 12, shroud 14, and vanes 16 according to yet another embodiment of the present invention. As previously described with respect to the embodiment shown in FIG. 1, each vane 16 generally comprises a curved surface 38 that imparts tangential velocity or swirl to the fuel 34 and/or working fluid 30 flowing over the vanes 16. However, instead of the radially outward portion 40 present in the previous embodiments, the vanes 16 extend radially across the entire annular passage 20 between the center body 12 and the shroud 14. In this particular embodiment, the shroud 14 includes a plurality of ports 48 proximate to the vacuum side 28 of the curved surfaces 38. The plurality of ports 48 may be angled toward the vacuum side 28 of the curved surfaces 38 to provide fluid communication for the fluid stream 46 to flow against the curved surfaces 38. In this manner, the fluid stream 46 may energize the low velocity regions to increase the flow velocities to reduce or prevent flame holding from occurring on the vacuum side 28 of the curved surfaces 38.

The embodiments previously described and shown in FIGS. 1-5 further provide a method for enhancing flow through the nozzle 10. The method may include flowing the fuel 34 through the center body 12 and/or the vanes 16 and flowing the fluid stream 46 across the vanes 16, as shown for example in FIGS. 3 and 5. The method may further include flowing the fluid stream 46 between the radially outward portion 40 of the vanes 16, as shown for example in FIGS. 2 and 4. In particular embodiments, the method may include flowing the fluid stream 46 through the opening 42 in the radially outward portion 40 and/or flowing the fluid stream 46 through the shroud 14 and against the vacuum side 28 of the vanes 16.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other and examples are intended to be within the scope of the claims if they include structural elements that do not differ from the literal language of the claims, or if they include equivalent structural elements with insubstantial differences from the literal languages of the claims.

What is claimed is:

1. A nozzle comprising:

a. a center body, wherein the center body defines an axial centerline;

b. a shroud circumferentially surrounding at least a portion of the center body to define an annular passage between the center body and the shroud; and c. a plurality of vanes that extend within the annular passage, each of the plurality comprising a leading edge that extends radially outward from the center body and that is fixed to an inner surface of the shroud, and a trailing edge that extends radially outward from the center body partially between the center body and the shroud to define a radial gap between the trailing edge of each of the plurality of vanes and the shroud.

2. The nozzle as in claim 1, wherein each of the plurality of vanes comprises a straight surface angled with respect to the axial centerline.

3. The nozzle as in claim 1, wherein each of the plurality of the vanes comprises a curved surface.

4. The nozzle as in claim 1, further comprising at least one fuel port in each of the plurality of vanes.

5. The nozzle as in claim 1, wherein the radially outward portion of each of the plurality of vanes is tapered radially inward from the shroud.

6. The nozzle as in claim 1, further comprising an opening in the radially outward portion of each of the plurality of vanes.

7. The nozzle as in claim 1, wherein each of the plurality of vanes comprises a pressure side and a vacuum side.

8. The nozzle as in claim 7, further comprising an aperture in at least one of the pressure side or vacuum side of each of the plurality of vanes.

9. The nozzle as in claim 7, further comprising a plurality of ports in the shroud, wherein each of the plurality of ports in the shroud is proximate to the vacuum side of each of the plurality of vanes.

10. A method for enhancing flow through a nozzle comprising:

a. flowing a fuel through a center body;

b. flowing a fluid stream across a vane located between the center body and a shroud surrounding at least a portion of the center body;

c. flowing the fluid stream across a leading edge of the vane that extends from the center body and connects to an inner surface of the shroud; and d. flowing the fluid stream from the leading edge across a gap defined between a radially outer portion of the vane and the shroud.

11. The method as in claim 10, further comprising flowing the fluid stream through an opening in the radially outward portion of the vane.

12. The method as in claim 10, further comprising flowing the fluid stream through the shroud and against a vacuum side of the vane.

13. The method as in claim 10, further comprising flowing the fuel through the vane.

14. A nozzle comprising:

a. a center body, wherein the center body defines an axial centerline;

b. a shroud circumferentially surrounding at least a portion of the center body to define an annular passage between the center body and the shroud; and c. a plurality of vanes disposed between the center body and the shroud, each of the plurality of vanes being connected to an inner surface of the shroud at a leading edge of each vane and each vane being tapered radially inward from the shroud from a point downstream from the leading edge to a trailing edge of each of the plurality of vanes, wherein the taper of each of the plurality of vanes defines a radially outer portion of each of the plurality of vanes.

15. The nozzle as in claim 14, wherein each of the plurality of the vanes comprises a curved surface.

16. The nozzle as in claim 14, further comprising at least one fuel port in each of the plurality of vanes.

17. The nozzle as in claim 14, wherein each of the plurality of vanes comprises a pressure side and a vacuum side.

* * * * *

UNITED STATES PATENT AND TRADEMARK OFFICE

CERTIFICATE OF CORRECTION

PATENT NO. : 8,579,211 B2
APPLICATION NO. : 12/985572
DATED : November 12, 2013
INVENTOR(S) : Mahesh Bathina and Willy Steve Ziminsky It is certified that error appears in the above-identified patent and that said Letters Patent is hereby corrected as shown below:

In the Claims

Claim 1, column 5, line 2, "sage, each of the plurality comprising a leading edge that" should read --sage, each of the plurality of vanes comprising a leading edge that--

Signed and Sealed this
Twenty-seventh Day of May, 2014

Michelle K. Lee

Michelle K. Lee
*Deputy Director of the United States Patent and Trademark Office*